United States Patent [19]

Lee

[11] Patent Number: 5,065,703

[45] Date of Patent: Nov. 19, 1991

[54] FLEXIBLE LANCE FOR STEAM GENERATOR SECONDARY SIDE SLUDGE REMOVAL

[75] Inventor: Robert A. S. Lee, Stoneham, Mass.

[73] Assignee: Electric Power Research Institute, Inc., Palo Alto, Calif.

[21] Appl. No.: 303,268

[22] Filed: Jan. 27, 1989

Related U.S. Application Data

[63] Continuation-in-part of Ser. No. 27,810, Mar. 18, 1987, Pat. No. 4,827,953.

[51] Int. Cl.[5] ..... F22B 37/52

[52] U.S. Cl. ..... 122/382; 15/316.1; 15/339; 73/866.5; 122/379; 134/113; 134/172; 239/548; 239/588; 250/227.20; 901/44

[58] Field of Search ..... 376/248, 249, 258, 260, 376/310, 316; 122/379, 380, 382, 390, 392, 405; 165/11.1, 11.2, 95; 134/104.1, 166 R, 172, 198, 57 R, 113, 167 C, 165 C; 15/316 R, 339; 73/866.5; 250/227.11, 227.20; 901/44, 47; 239/548, 588; 604/95

[56] References Cited

U.S. PATENT DOCUMENTS

| | | | |
|---|---|---|---|
| 3,625,200 | 12/1971 | Muller | 604/95 X |
| 3,676,671 | 7/1972 | Sheldon | 250/227.2 X |
| 3,911,750 | 10/1975 | Prasher | 73/866.5 |
| 4,286,585 | 9/1981 | Ogawa | 250/227.2 X |
| 4,424,769 | 1/1984 | Charamathieu et al. | 122/342 |
| 4,566,843 | 1/1986 | Iwatsuka et al. | 901/44 X |
| 4,638,667 | 1/1987 | Zimmer et al. | 73/866.5 |
| 4,753,223 | 6/1988 | Bremer | 604/95 X |
| 4,826,087 | 5/1989 | Chinery | 239/588 X |

*Primary Examiner*—Philip R. Coe

*Attorney, Agent, or Firm*—Flehr, Hohbach, Test, Albritton & Herbert

[57] ABSTRACT

A system (10) for lancing sludge deposits (12) from within a bundle (14) of vertically extending steam generator tubes (16) of a PWR steam generator secondary side assembly (18) has a flexible lance (28) mounted in a lance guide/housing transporter (30). The transporter (30) is movable along blowdown lane (20) to position end (32) of the flexible lance opposite one of the inter-tube lanes (26) so that the flexible lance (28) may be inserted along the selected inter-tube lane (26). A rigid lance guide (34) on the transporter (30) has a curved end (36) configured to turn the flexible lance (28) at a chosen angle, such as 90°, so that the flexible lance (28) will be fed into the selected inter-tube lane (26). The transporter has a drive (37) for advancing the flexible lance (28) through end (36) of the lance guide (34) and into the inter-tube lane (26). The flexible lance (28) includes a flexible plastic extrusion (38) with a plurality of hollow, flexible metal conduits (40) within the plastic extrusion (38) to extend lengthwise along the lance (28). The nozzle block (44) has nozzles 48, 50 and 52 so that all portions of the sludge deposits (12) adjacent to the selected inter-tube lane (26) can be reached by the flexible lance (28).

43 Claims, 14 Drawing Sheets

FLEXIBLE LANCE FOR STEAM GENERATOR SECONDARY SIDE SLUDGE REMOVAL

CROSS REFERENCE TO RELATED APPLICATION

This application is a continuation-in-part of my copending, commonly assigned application Ser. No. 07/027,810, filed Mar. 18, 1987, now U.S. Pat. No. 4,827,953.

BACKGROUND OF THE INVENTION

1. Field of the Invention

This invention relates to a novel structure for positioning an orifice for discharging a cleaning fluid jet inside a structure having a plurality of interconnected passages close to deposits to be removed from difficult to access passages inside the structure. More particularly, it relates to such a structure for reaching into steam generator tube bundles and similar assemblies for sludge breakup and removal in an improved manner.

2. Description of the Prior Art

The accumulation of sludge on the secondary side of pressured water reactor (PWR) steam generators in the nuclear power industry is an acute problem which has historically resulted in costly equipment maintenance, replacement and plant down-time. The sludge is a buildup of magnetite and copper compounds which originate in copper alloy condenser tubing and carbon steel condensate and feedwater piping. Removal of sludge is often difficult due to poor access and physical characteristics of the sludge material.

All presently used sludge lancing equipment depends on precise aiming of high pressure water jets from convenient, accessible locations within the typical steam generator. Such areas include the central blowdown lane and/or the annular area between the outer edge of the tube bundles and the internal diameter of the steam generator vessel. However, bare, high pressure water jets, traveling across distances of up to four feet or more have little chance for being delivered effectively to the location of the sludge, due to jet divergence, attendant loss of centerline velocity and interference caused by impact on tubes before the target sludge is reached. Documented success in removal of sludge using these techniques has been less than satisfactory, due primarily to the fact that a high pressure water stream quickly loses its energy as it leaves its high pressure nozzle orifice. As the jet's pressure dissipates in free space, its coherence, or tight focus, also degrades, severely reducing its material-erosion capability. A need therefore exists for improvement of sludge lancing techniques in steam generator tube bundles and similar difficult to access structures.

SUMMARY OF THE INVENTION

Accordingly, it is an object of this invention to provide a structure for positioning an orifice for discharging a cleaning fluid jet inside a structure having a plurality of interconnected passages close to deposits to be removed from difficult to access passages inside the structure.

It is another object of the invention to provide such a structure which will allow full system pressure of the cleaning fluid to be directed locally at the material to be removed at negligible standoff distances, for example, within 1 inch or less.

It is a further object of the invention to provide such a structure which will position a discharge orifice at essentially any desired position within dense tube nests of steam generator tube bundles and similar difficult to access structures.

It is a still further object of the invention to provide a system for moving the structure opposite to an opening of a difficult to access passageway.

It is yet another object of the invention to provide such a structure and system which is able to operate at elevated radiation levels.

These and related objects may be achieved through use of the novel flexible lance structure and system herein disclosed. A flexible lance in accordance with this invention for supplying a cleaning fluid under pressure to sludge deposits in an assembly having a difficult to access geometry includes a flexible member. A plurality of hollow, flexible tubes extend lengthwise along the flexible member. There are a plurality of nozzles at an end of the flexible member. The plurality of nozzles is connected to the plurality of flexible tubes. The flexible member is configured to be driven into the difficult to access geometry.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
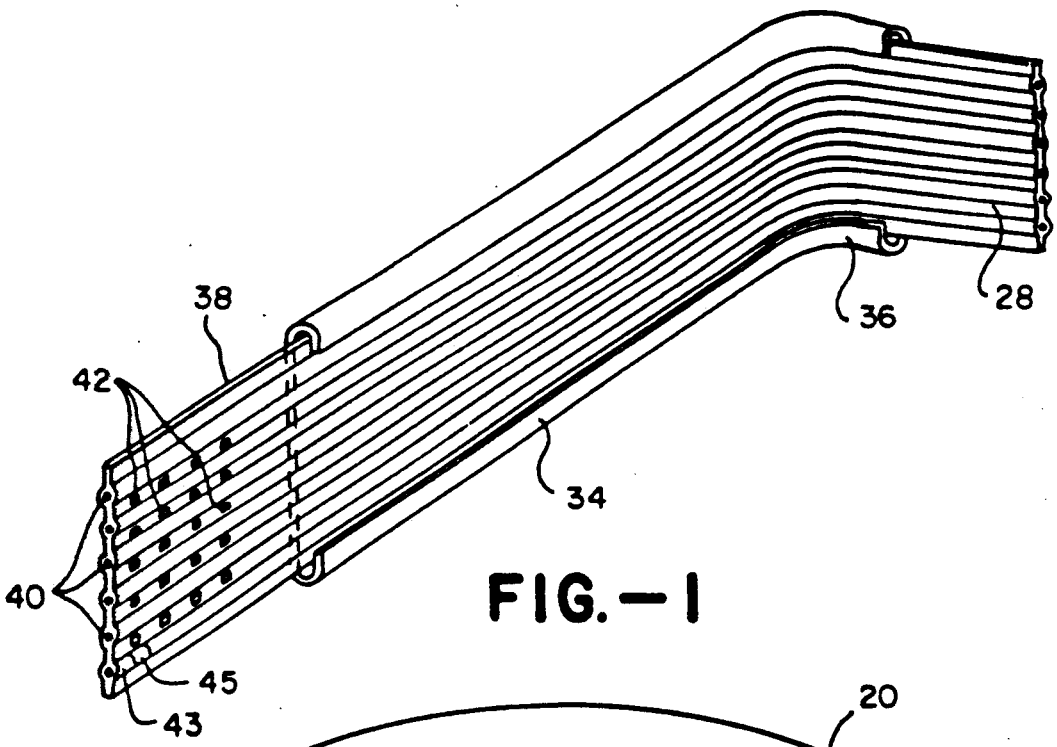
FIG. 1 is a perspective view of a flexible lance in accordance with the invention.
Figure 2:
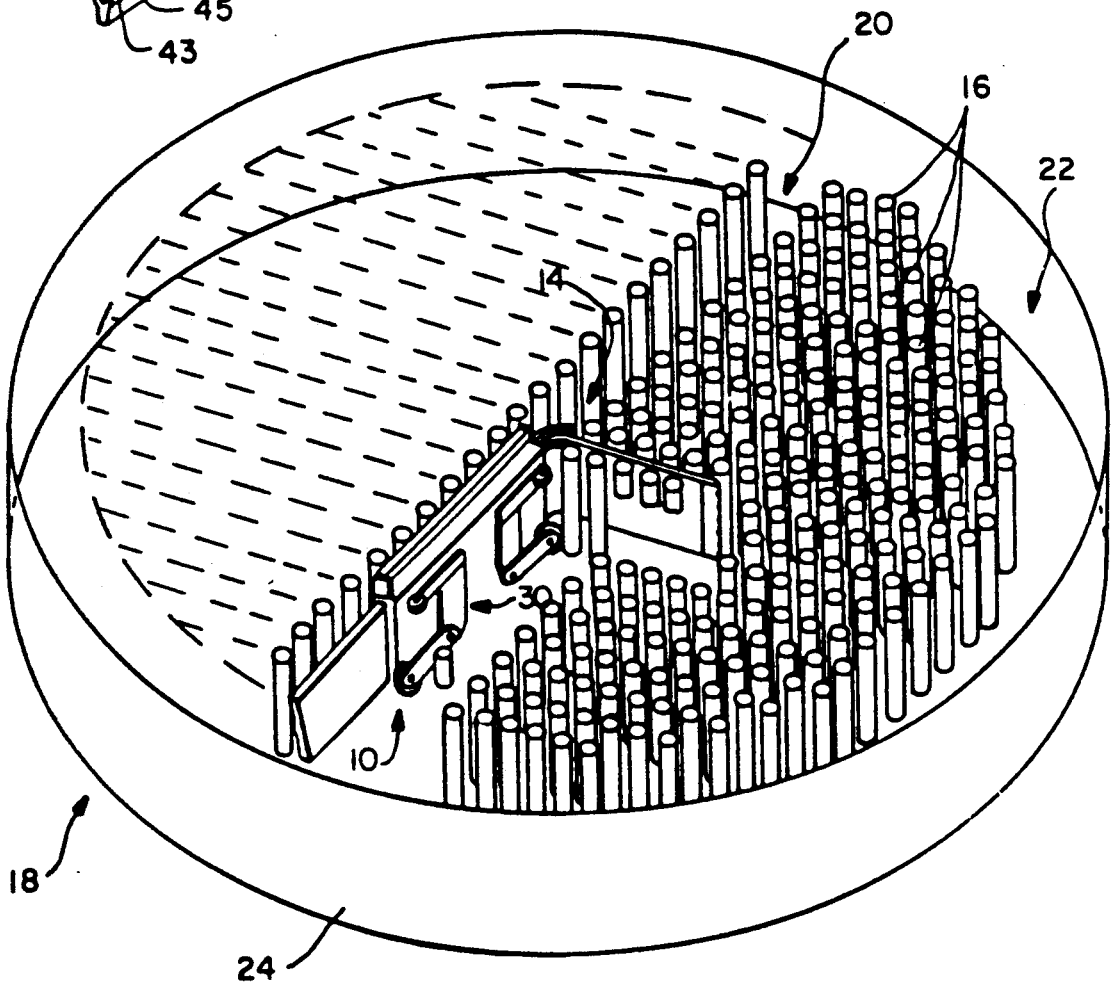
FIG. 2 is a perspective view of the flexible lance of FIG. 1 in position for use as part of a system in a secondary side of a PWR steam generator.
Figure 2A:
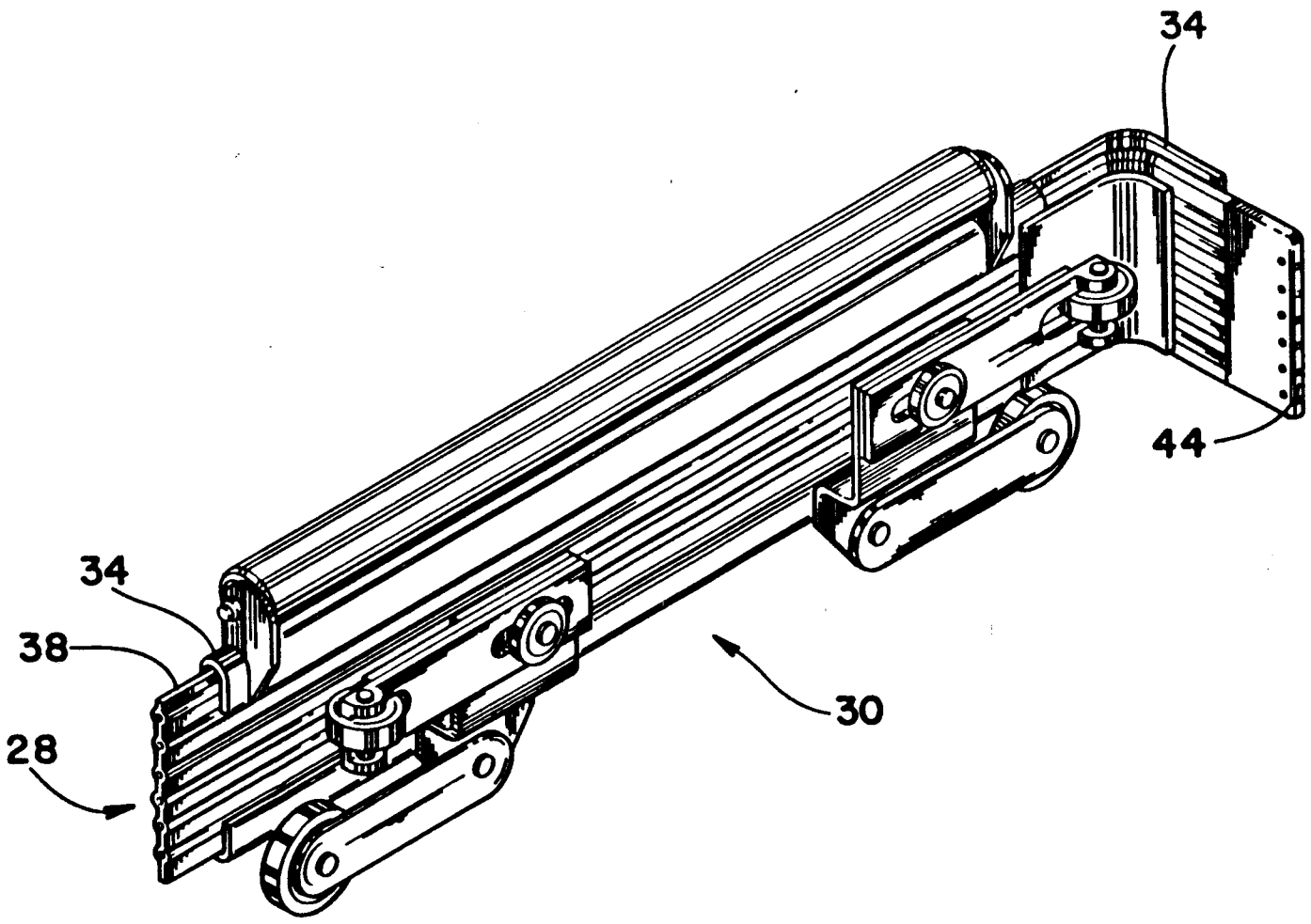
FIG. 2A is an enlarged perspective view of the flexible lance system shown in FIG. 2.
Figure 3:
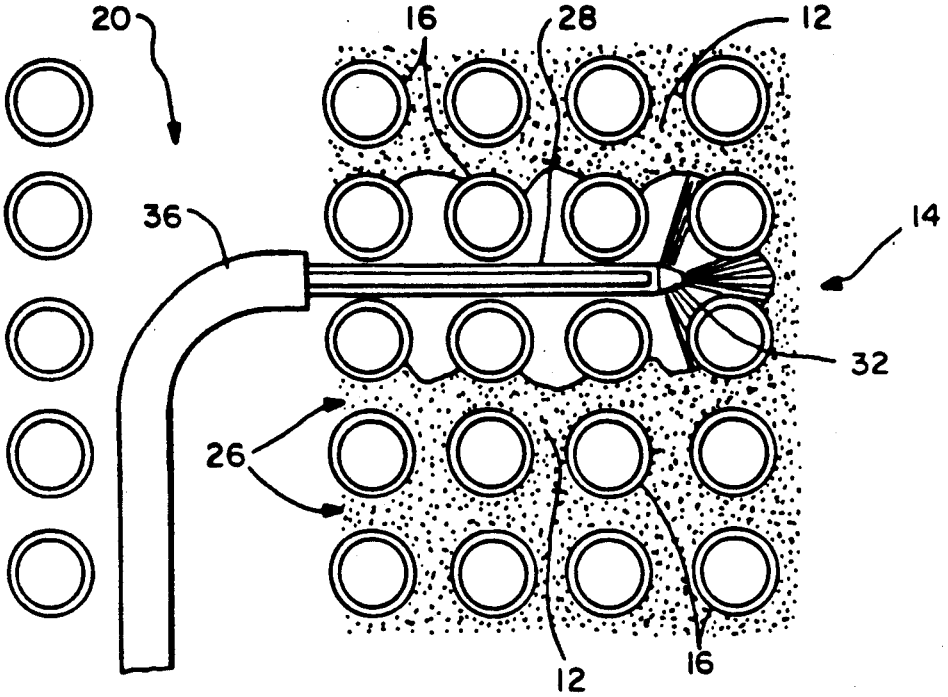
FIG. 3 is a top view of a portion of the flexible lance and system of FIGS. 1 and 2 in use.
Figure 4A:
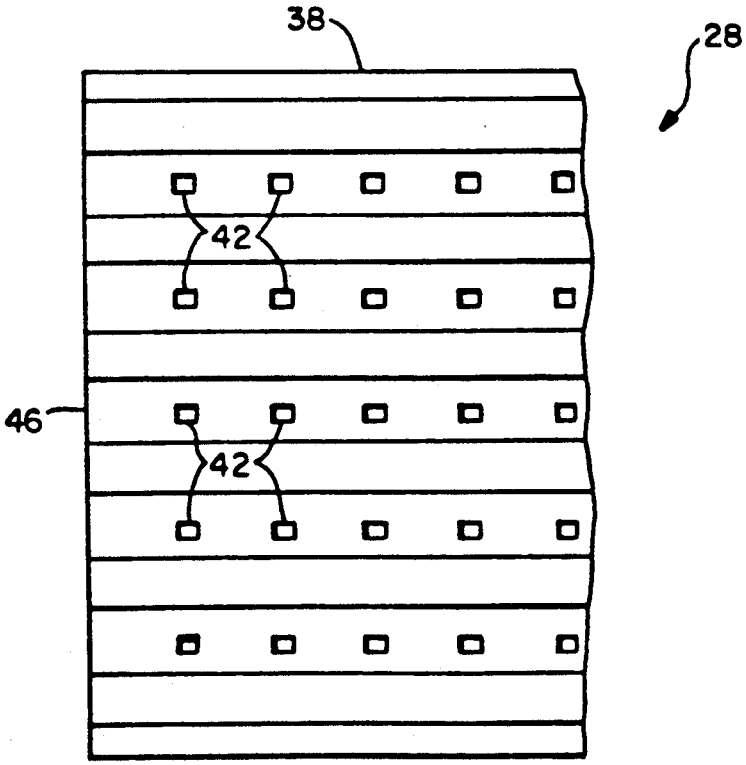
FIGS. 4A and 4B are side and end views, respectively, of a portion of the flexible lance of FIG. 1.
Figure 4B:
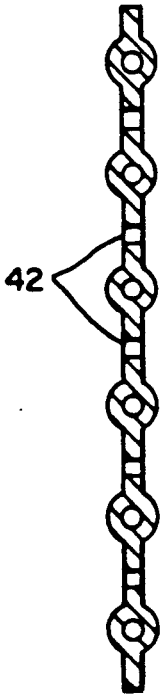
Figure 5A:
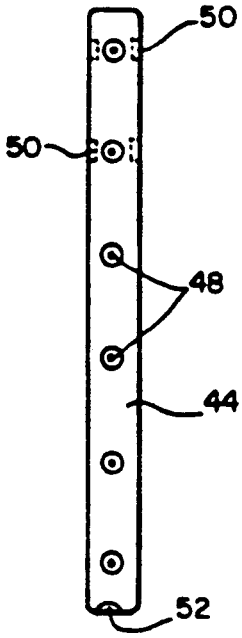
FIGS. 5A and 5B are end and side views, respectively, of the flexible lance of FIGS. 1 and 4.
Figure 5B:
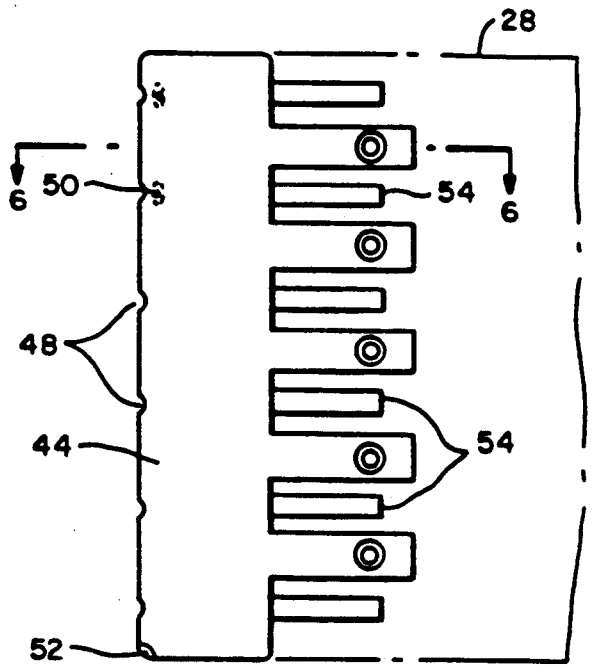
Figure 6:
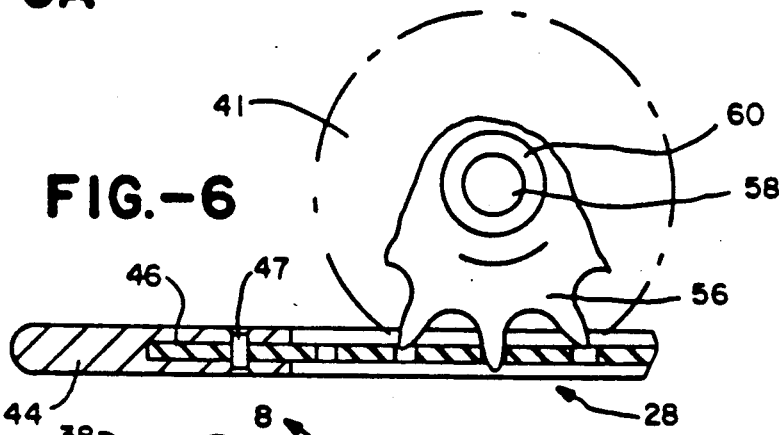
FIG. 6 is a cross section view taken along the line 6—6 in FIG. 5.
Figure 7:
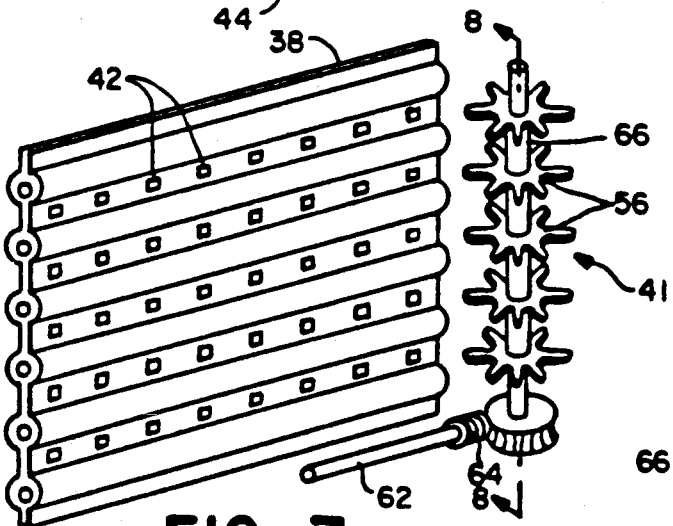
FIG. 7 is a partially exploded schematic representation of a portion of the system of FIGS. 1-3.
Figure 8:
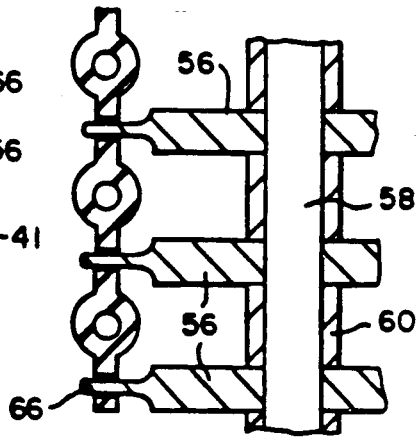
FIG. 8 is a cross section view taken along the line 8—8 in FIG. 7.

Turning now to the drawings, more particularly to FIGS. 1-3, there is shown a system 10 for lancing sludge deposits 12 from within a bundle 14 of vertically extending steam generator tubes 16 of a PWR steam generator secondary side assembly 18. The assembly 18 consists of the bundle 14 of the steam generator tubes 16 arranged in generally semicircular patterns, separated by a blowdown lane 20, encircled by an annular space 22 and enclosed by steam generator walls 24. Each of the tube 16 bundles 14 has a plurality of inter-tube lanes 26 intersecting the blowdown lane 20 and the annular space 22. As explained above, the prior art approach for removing the sludge deposits 12 from the bundles 14 is to direct jets of water from an apparatus positioned in the blowdown lane 20 or the annular space 22 toward the sludge deposits 12 in the bundles 14.

The system 10 of this invention includes a flexible lance 28 mounted in a lance guide/housing transporter 30, which is movable along the blowdown lane 20 to position end 32 of the flexible lance opposite one of the inter-tube lanes 26 so that the flexible lance 28 may be inserted into any selected inter-tube lane 26. A rigid lance guide 34 on the transporter 30 has a curved end 36 configured to turn the flexible lance 28 at a chosen angle, such as 90°, so that the flexible lance 28 will be fed into the selected inter-tube lane 26. The curved end 36 consists of an inner guide 37 and an outer guide 39 for the flexible lance 28. The transporter has a drive 41 for advancing the flexible lance 28 through end 36 of the lance guide 34 and into the inter-tube lane 26.

The flexible lance 28 includes a flexible plastic extrusion 38 with a plurality of hollow, flexible metal conduits 40, for example, formed from flexible stainless steel or brass, within the plastic extrusion 38 to extend lengthwise along the lance 28. For example, the conduits 40 are desirably implemented with helically wound cartridge brass 43 core covered with a braided brass sheath 45. This structure will withstand a pressure of up to about 10,000 psi. The extrusion 28 can be fabricated of any suitable flexible plastic, such as a medium density polyethylene. Preferably, the extrusion 28 is extruded from a high strength nylon, delrin or similar material. The conduits 40 are separated by rows of sprocket holes 42 in the extrusion 38.

Further details of the flexible lance 28 and the drive 41 are shown in FIGS. 4-8. The flexible lance 28 has a nozzle block 44 attached to end 46 by soldering or by means of flat rivets 47 mounted through the first sprocket holes 42 on end 46. The nozzle block 44 has forward spraying nozzles 48, side spraying nozzles 50 and down spraying nozzles 52 so that all portions of the sludge deposits 12 adjacent to the selected inter-tube lane 26 can be reached by the flexible lance 28. A plurality of stainless steel thin wall tubes 54 project from the nozzle block 44 to engage the conduits 40 in the extrusion 38. When soldering is used to attach the nozzle block 44 to the extrusion 38, the tubes 54 are soldered to the core 43 of the conduits 40. The drive 41 has a set of sprockets 56 fixedly attached to a shaft 58 and separated by spacers 60. A flexible cable drive 62 is connected to worm gear 64 to drive the shaft 58. Teeth 66 of the sprockets 56 engage the apertures 42 in the extrusion 38 to drive the flexible lance 28 out the end 36 of the lance guide 34 down the inter-tube lanes 26. The drive 41 insures even feeding of the lance 28 from its top to its bottom. Because the drive 41 operates without slippage, counting its revolutions provides a reliable indicator of the position of the lance 28 within an inter-tube lane 26.

Figure 9:
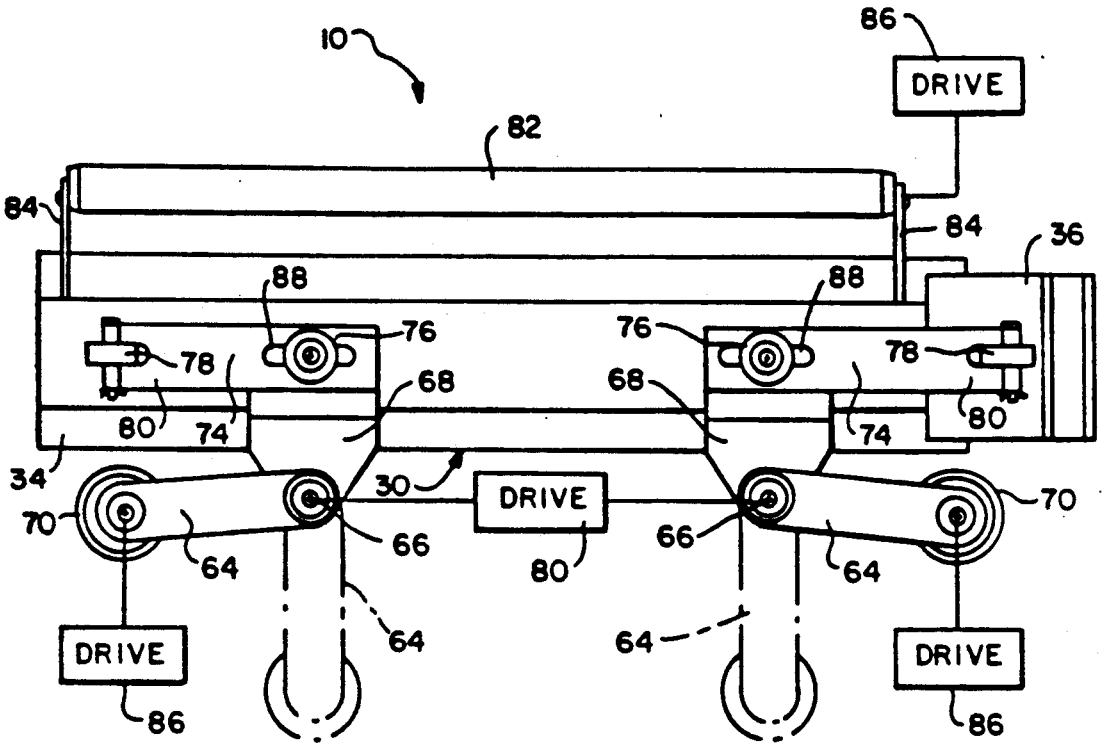
FIG. 9 is a side view of a portion of the system of FIGS. 1-3.
Figure 10:
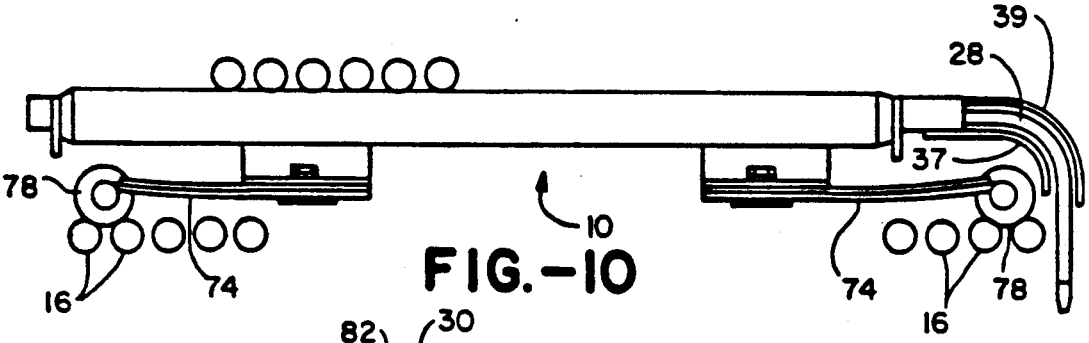
FIG. 10 is a top view of the system portion of FIG. 9.
Figure 11:
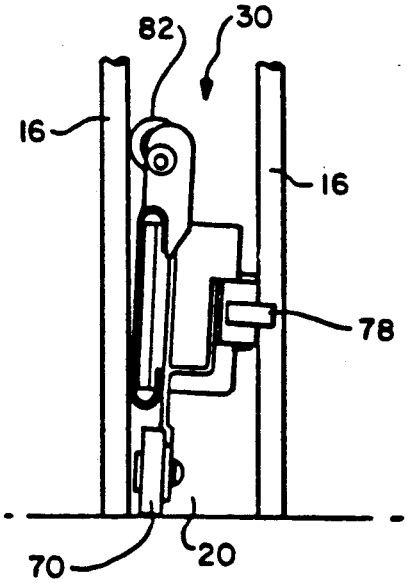
FIG. 11 is an end view of the system portion of FIGS. 9 and 10.

Details of the lance guide/housing transporter 30 are shown in FIGS. 9-11. The lance guide 34 serves as a body of the transporter 30. Wheel arms 64 are pivotally attached at one end 66 to support brackets 68, with drive wheels 70 rotatably mounted at the other end 72 of the wheel arms 64. Horizontal wheel arms 74 are fixedly attached to the bracket 68 by their ends 76, with horizontal wheels 78 rotatably attached to the ends 80 of the horizontal wheel arms 74. Tilt bar 82 is eccentrically mounted for rotation on brackets 84, which are fixedly attached to the lance guide 34. Drives 86, desirably implemented as flexible cable driven worm gear drives, are connected to the wheel arms 64, drive wheels 70 and the tilt bar 82.

Referring to FIGS. 2, 3 and 9-11, operation of the system 10 will now be explained. The transporter 30, which is positioned in the blowdown lane 20, is moved with the drive wheels 70 to position end 36 of the lance guide 34 opposite an inter-tube lane 26 down which the flexible lance 34 is to be inserted. The horizontal wheels 78 engage the steam generator tubes 16, as is best shown in FIG. 10, to provide precise positioning of the end 36 opposite the selected inter-tube lane 26. Slots 88 on the horizontal wheel arms 74 allow adjustment of the positions of the horizontal wheels 78 relative to the end 36 to compensate for different geometries of the intertube lanes 26. As is best shown in FIG. 11, the tilt bar 82 engages the steam generator tubes 16 on the other side of the blowdown lane 20 from the steam generator tubes 16 engaged by the horizontal wheels 78, so that the lance guide 34 can be tilted from the horizontal to position the flexible lance 28 with respect to different points of the sludge deposits 12. As indicated in phantom in FIG. 9, the lance guide 34 may also be raised and lowered by pivoting the wheel arms 64. With the flexible lance 28 in position, water or other cleaning fluid under high pressure, for example, 5000 psig, is forced from the nozzles 48, 50 and 52 to jet the sludge deposits into the annular space 22 for removal in a conventional manner.

Figure 12:
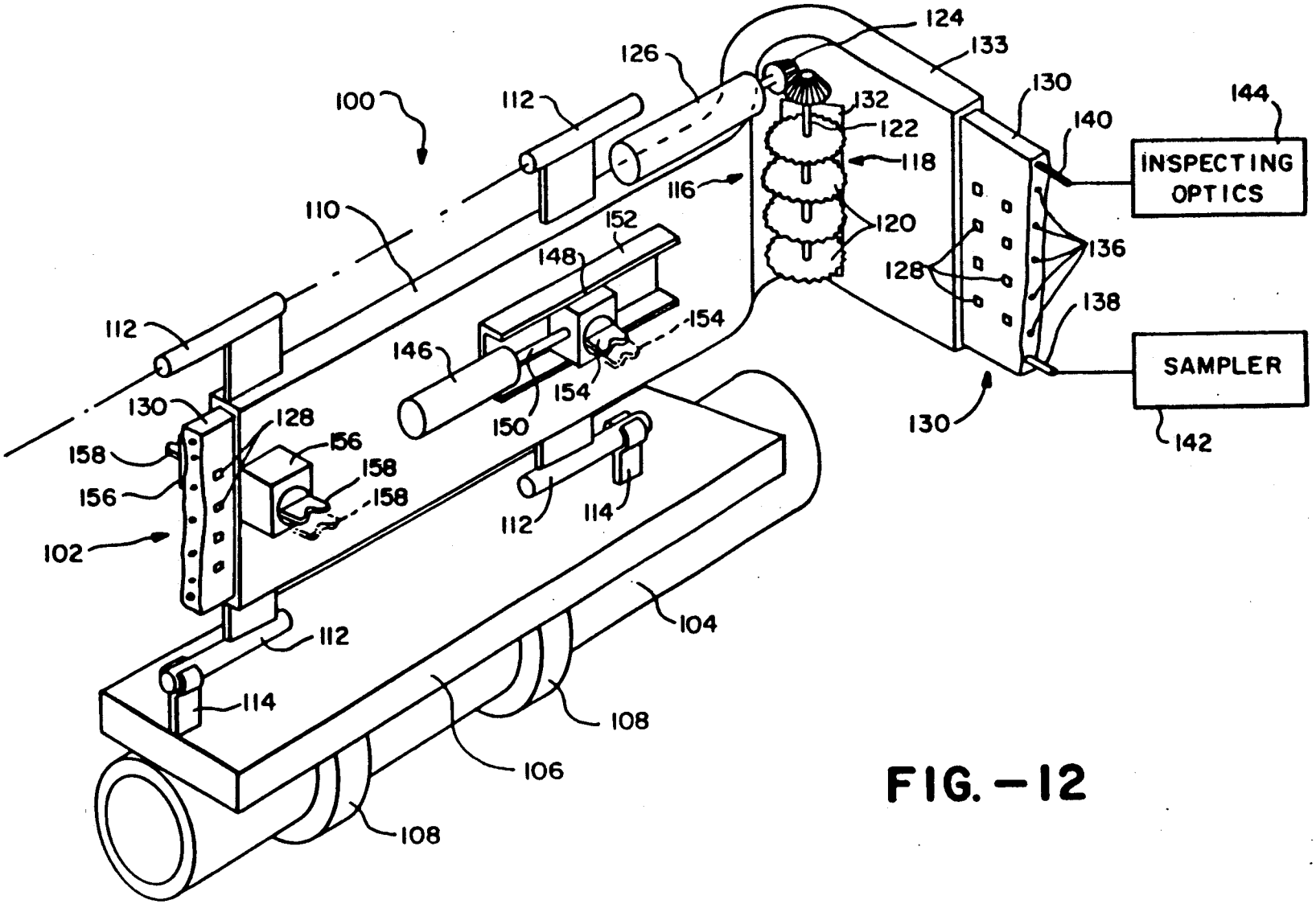
FIG. 12 is a perspective view of another embodiment of a system in accordance with the invention.

FIG. 12 shows another embodiment of a flexible lance system 100, having a transporter 102 designed to ride along blowdown pipe 104. The transporter 102 has a pipe riding cart 106 with roller bearing clamps 108, which pivot laterally to grip the blowdown pipe 104 as shown. Lance guide 110 is attached to the pipe riding cart 106 by means of cylinders 112 engaging trunnions 114. One set of the cylinders 112 engages the trunnions for right side lancing as shown. For left side lancing, the lance guide 110 is inverted so that the other set of cylinders 112 engages the trunnions 114. Drive 116 has a stack 118 of sprockets 120 mounted for rotation with shaft 122, driven by bevel gears 124 and gas turbine 126. Sprockets 120 engage sprocket holes 128 of flexible lance 130 through opening 132 in curved end 133 of the lance guide 110. The flexible lance 130 has a plastic extrusion 134 and a plurality of conduits 136 extending lengthwise along the plastic extrusion 134. Additionally, a flexible cable 138 and a fiber optics cable 140 run along the plastic extrusion 134 in passages above and below the conduits 136. The conduits 136 have the same construction as the conduits 40 in the FIGS. 1-11 embodiment. The flexible cable 138 is movable within the plastic extrusion 134 to operate a sludge sampler 142, which is connected to the flexible cable 138. Inspecting optics 144 are connected to the fiber optics cable 140 to view the interior of a steam generator or other difficult to access geometry in which the flexible lance system 100 is used.

The transporter 102 is moved along the blowdown pipe 104 by means of a propulsion air cylinder 146, connected to an air cylinder 148 by means of a piston rod 150. The air cylinder 148 is slideably mounted in a track 152. The air cylinder 148 reciprocates a gripper 154, which moves laterally of the lance guide 110, as indicated in phantom, to engage steam generator tubes on the side of the blowdown lane in which the blowdown pipe 104 is located. The air cylinder 146 is actuated with the gripper 154 engaging a steam generator tube to move the cart 106 along the pipe 104. Air cylinders 156 reciprocate grippers 158 to engage the steam generator tubes for inclining the lance guide 110 in a similar manner to lance guide 34 (see also FIG. 11). Except as shown and described, the construction and 10 operation of the FIG. 12 embodiment of the invention is the same as that of the FIGS. 1-11 embodiment.

Figure 13:
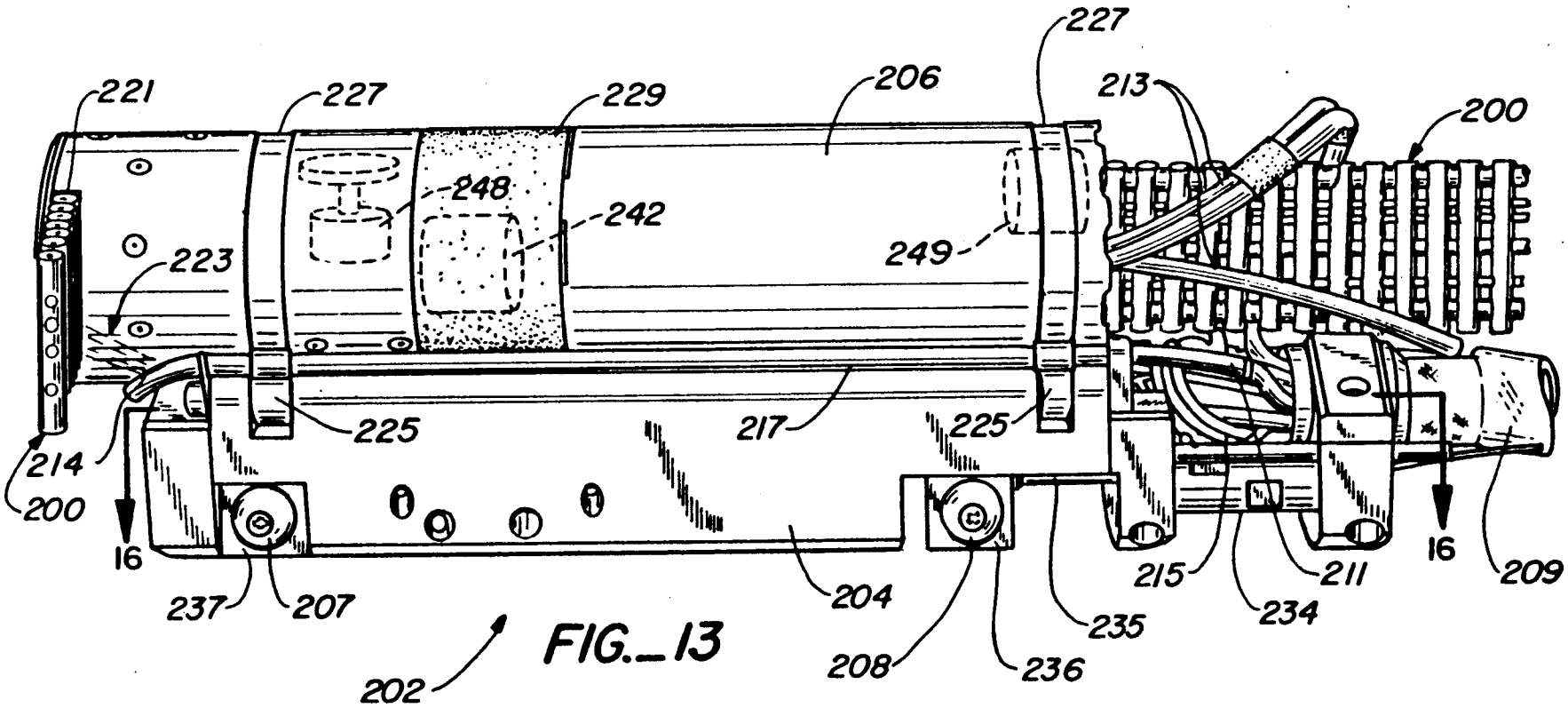
FIG. 13 is a side view of a third embodiment of a system in accordance with the invention.
Figure 14:
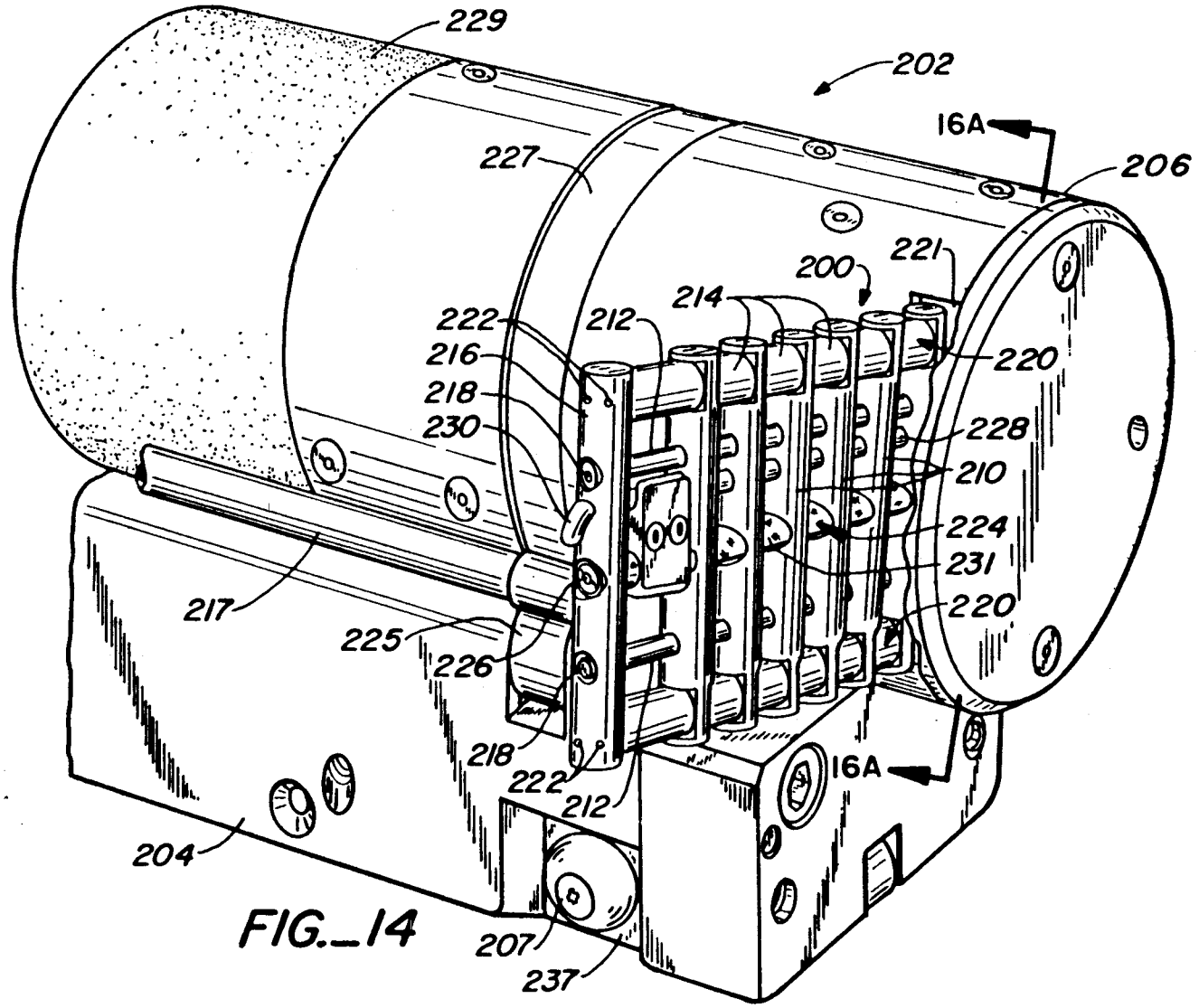
FIG. 14 is a perspective view of a portion of the system of FIG. 13.
Figure 15:
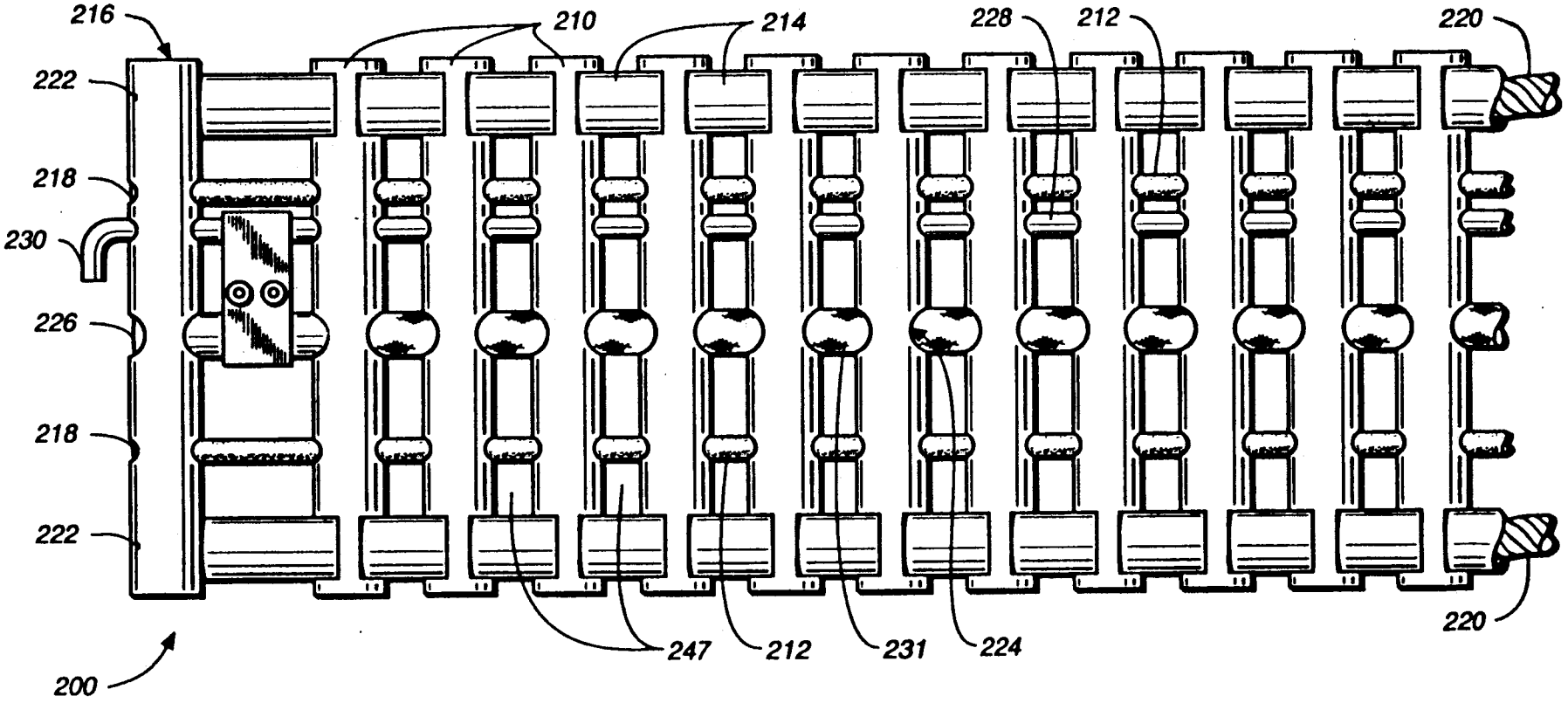
FIG. 15 is a plan view of another portion of the system of FIGS. 13-14.

FIGS. 13-15 show a third form of a flexible lance 200 and system 202 for the removal of sludge deposits from difficult to access geometries. The system 202 includes a transporter 204 having a lance guide/housing 206 through which the flexible lance 200 is driven. The transporter 204 is movable along the blowdown lane 20 (FIG. 1) by means of reciprocating feet 208 on both sides of the transporter 204 which extend outward between adjacent tubes 16 along the blowdown lane 20 and move backward along the transporter 204 in their extended position to propel the transporter forward along the blowdown lane. The feet 208 are then retracted and moved forward to complete a cycle of motion which is comparable to a breast stroke. Reversing this cycle allows the transporter 204 to move backward in the blowdown lane. Front feet 207 on both sides of the transporter 204 have the same configuration as the feet 208 and extend outward from the transporter 204 in the same manner between adjacent tubes to hold the transporter 204 in position, but do not reciprocate. The transporter 204 is connected to an umbilical bundle 209, which includes lower pressure water lines 211, compressed nitrogen lines 213 and electrical lines 215 connected to sensors in the transporter 204. The water lines 211 are each connected to a water spray delivery tube 217 on each side of the lance guide/housing 206, which have a slotted opening 219 (see also FIG. 17) directed at the flexible lance 200 as it enters rectangular opening 221 at the front of the lance guide/housing 206. Spray 223 cleans debris from the flexible lance 200 before it enters the lance guide/housing 206 when it is being retracted from an extended position. The nitrogen lines 213 are connected to operate the movable feet 207 and 208 and to rotate the lance guide/housing 206 for directing the flexible lance 200 to the right or left as it exits from the opening 221. Copper rollers 225 engage the lance guide/housing 206 at grooves 227 to facilitate its rotation. The lance guide/housing 206 is rotated by means of a wide, cogged rubber belt 229 which encircles the lance guide/housing 206 near its midpoint.

FIGS. 14 and 15 show details of the flexible lance 200. The flexible lance 200 is made up of separate hard nylon (available under the trademark Delrin) segments 210 that are strung on a pair of steel cables 212 which run the length of the flexible lance 200. The segments 210 are separated at their top and bottom by Teflon spacers 214. The steel cables 212 are attached to a nozzle block 216 by means of studs 218. Upper and lower high pressure water conduits 220 pass through the segments 210 and the spacers 212 and are connected to water jet orifices 222 on the front of the nozzle block 216. The high pressure water conduits have the same construction as the conduits 40 in the FIGS. 1-11 embodiment. A 6 mm Welch Allyn VideoProbe 224 passes through the segments 210. At its tip, the VideoProbe 224 has a charge coupled device (CCD) camera 226 which is fixed in the nozzle block 216 at the end of an optical cable 231. The optical cable supplies light to illuminate an area to be viewed with the CCD camera 226. A nitrogen line 228 passes through the segments 210 and is connected to a nozzle 230 positioned on the front of the nozzle block to direct nitrogen blasts at the camera lens 226 for keeping it free of debris.

Figure 16:
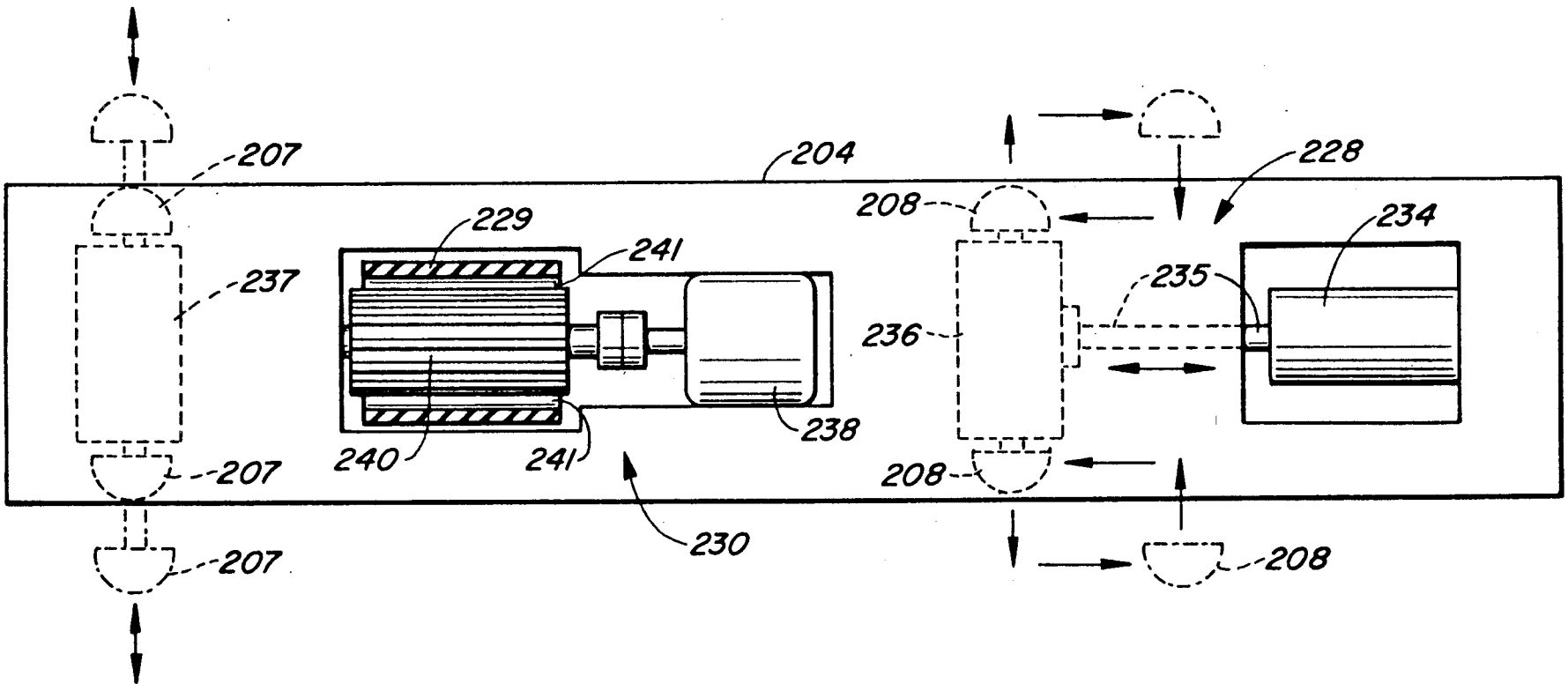
FIG. 16 is a cross section view taken along the line 16—16 in FIG. 13.
Figure 16A:
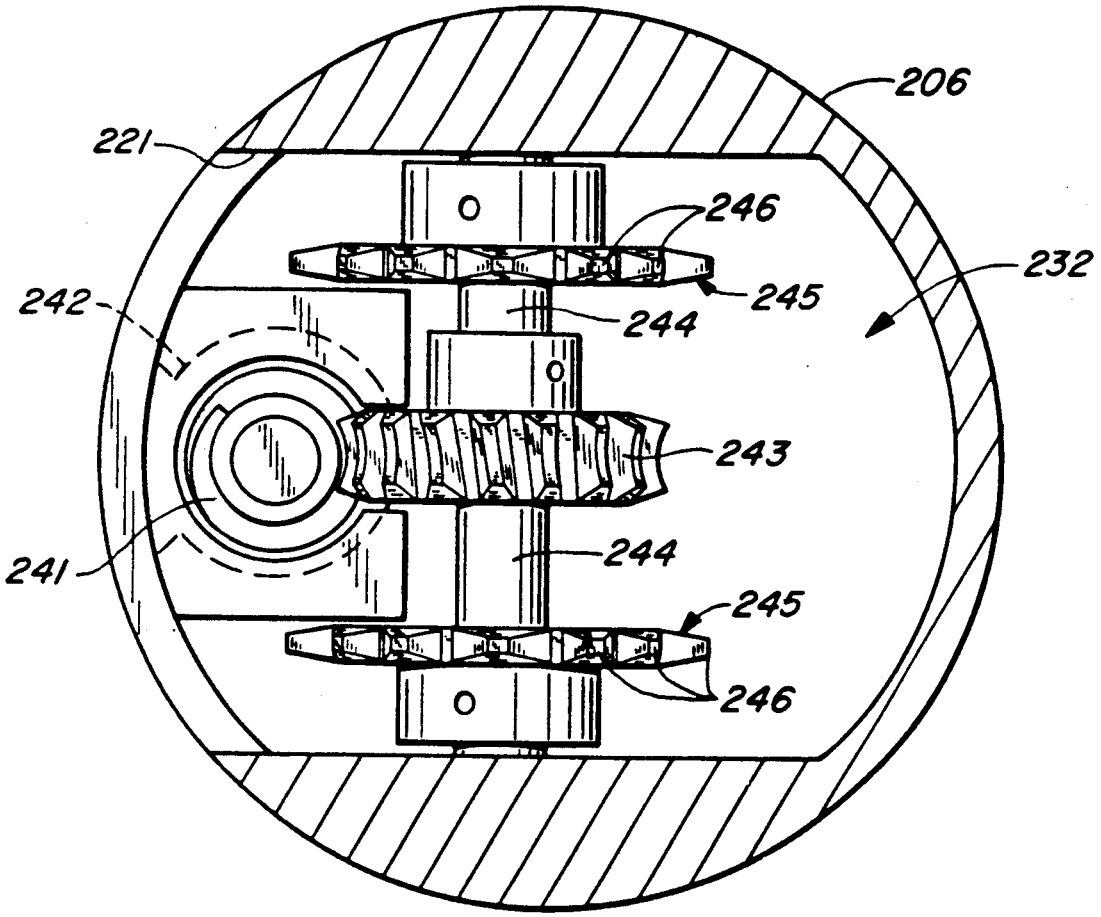
FIG. 16A is a cross section view, taken along the line 16A—16A in FIG. 14.

Details of the actuating mechanisms 228, 230 and 232 for the movable feet 208, the rubber belt 229, and for driving the flexible lance 200 through the lance guide/housing 206 are shown in FIGS. 16 and 16A. In the actuating mechanism 228 (FIG. 16), the feet 208 are reciprocated by pneumatic cylinder 234 connected at a right angle by shaft 235 to pneumatic cylinders 236, which extend and retract the feet 208. For forward locomotion of the transporter 204, the feet 208 are extended between adjacent tubes 16 along the blowdown lane 20 using the pneumatic cylinders 236, then moved backward along the transporter 204 with the pneumatic cylinder 234, retracted with the pneumatic cylinders 236, and moved forward with the pneumatic cylinder 234 as indicated in FIG. 16. The front feet 207 are similarly connected to pneumatic cylinders 237 to extend and retract, but do not move backward and forward. In the mechanism 230 (FIG. 16), a pneumatic motor 238 is mounted in the transporter 204 and is coupled to rotate a specially machined drive gear 240 which engages teeth 239 on the underside of the cogged rubber belt 229. In the mechanism 232 (FIG. 16A), a bronze worm 241 is directly coupled to an axially mounted pneumatic drive motor 242. The worm 241 drives worm gear 243, mounted on a shaft 244 with two sprocket drivers 245 having teeth 246 which mate with interstices 247 (see FIG. 15) in the flexible lance 200. Two precision transducers 248 and 249 are provided in the lance guide/housing 206 to provide continuous monitoring of the flexible lance 200 extension into the tube bundle and rotation of the lance guide/housing 206. The lance position transducer 248 (See FIG. 13) is a precision multiturn potentiometer which is calibrated to "count" the segments 210 as the flexible lance 200 is extended into or retracted from an intertube lane. The barrel tilt angle sensor 249 (See FIG. 13) is a precision rotary potentiometer with a pendulum weight which maintains the potentiometer wiper in a fixed, vertical attitude as the lance guide/housing 206 (and therefore the potentiometer casing) revolves.

Figure 17:
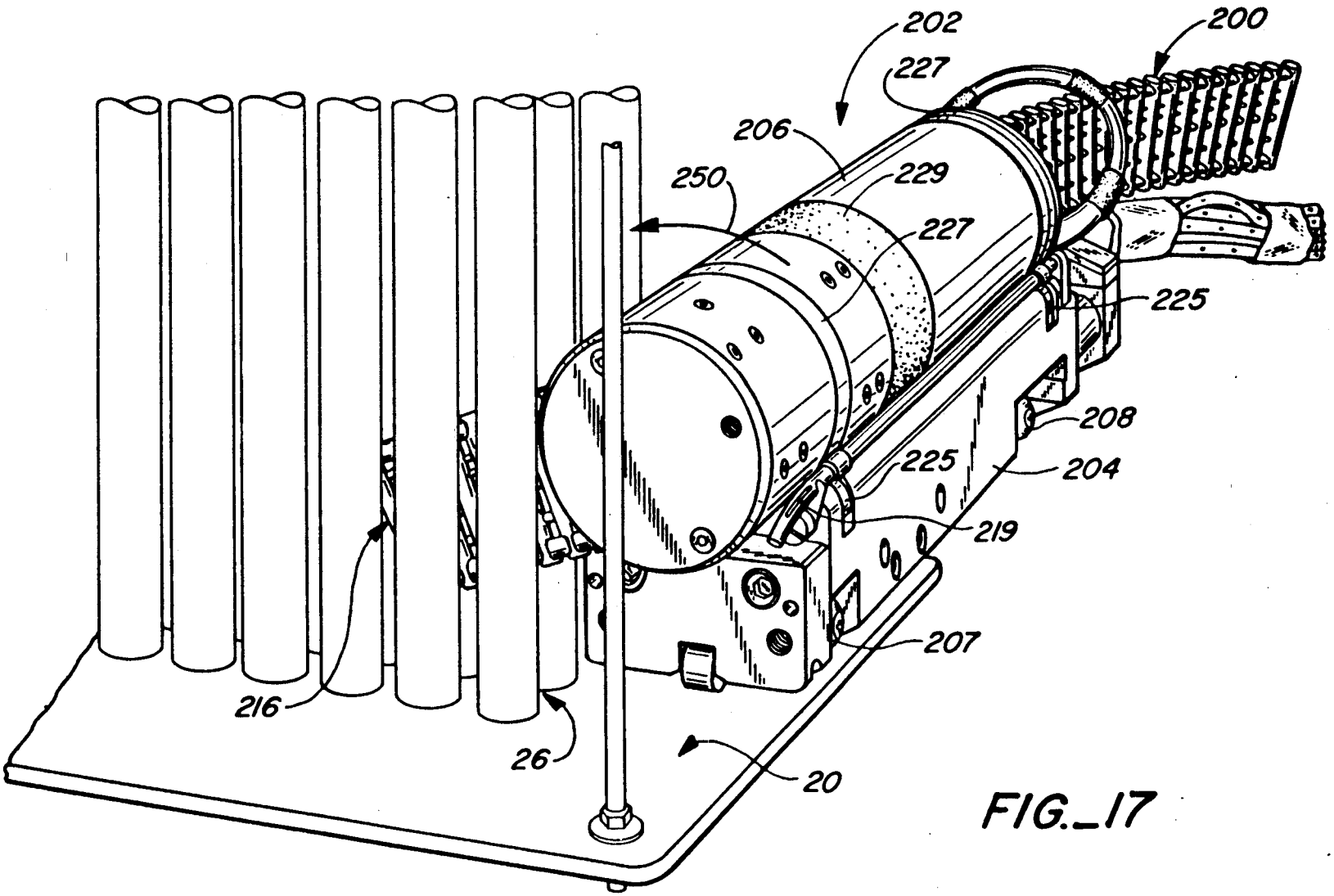
FIG. 17 is a front view of the system of FIGS. 13-16 in use.

FIG. 17 shows how the flexible lance system 202 is used. The transporter 204 is moved along the blowdown lane 20 between the tube bundles 14 until the rectangular opening 221 (FIG. 13) is opposite an intertube lane 26 down which it is desired to insert the flexible lance 200. The lance guide/housing 206 is then rotated as indicated by arrow 250 to orient the flexible lance 200 to its desired orientation as it exits from the lance guide/housing 206. The flexible lance is then driven through the lance guide/housing until it is extended a desired extent into the selected inter-tube lane 26. As the flexible lance 200 is extended, the high pressure water jets are discharged through the nozzles 222 (FIG. 14) to blast away sludge deposits as the flexible lance 206 advances. When cleaning of the selected inter-tube lane 26 has been completed, the flexible lance 200 is withdrawn from that lane 26, and the transporter 204 may then be moved with movable feet 208 to position the rectangular opening 221 (FIG. 14) opposite another inter-tube lane 26. Other than as shown and described, the construction and operation of the flexible lance system 202 is the same as that of the flexible lance systems 10 and 100 shown in FIGS. 1-12.

Figure 18:
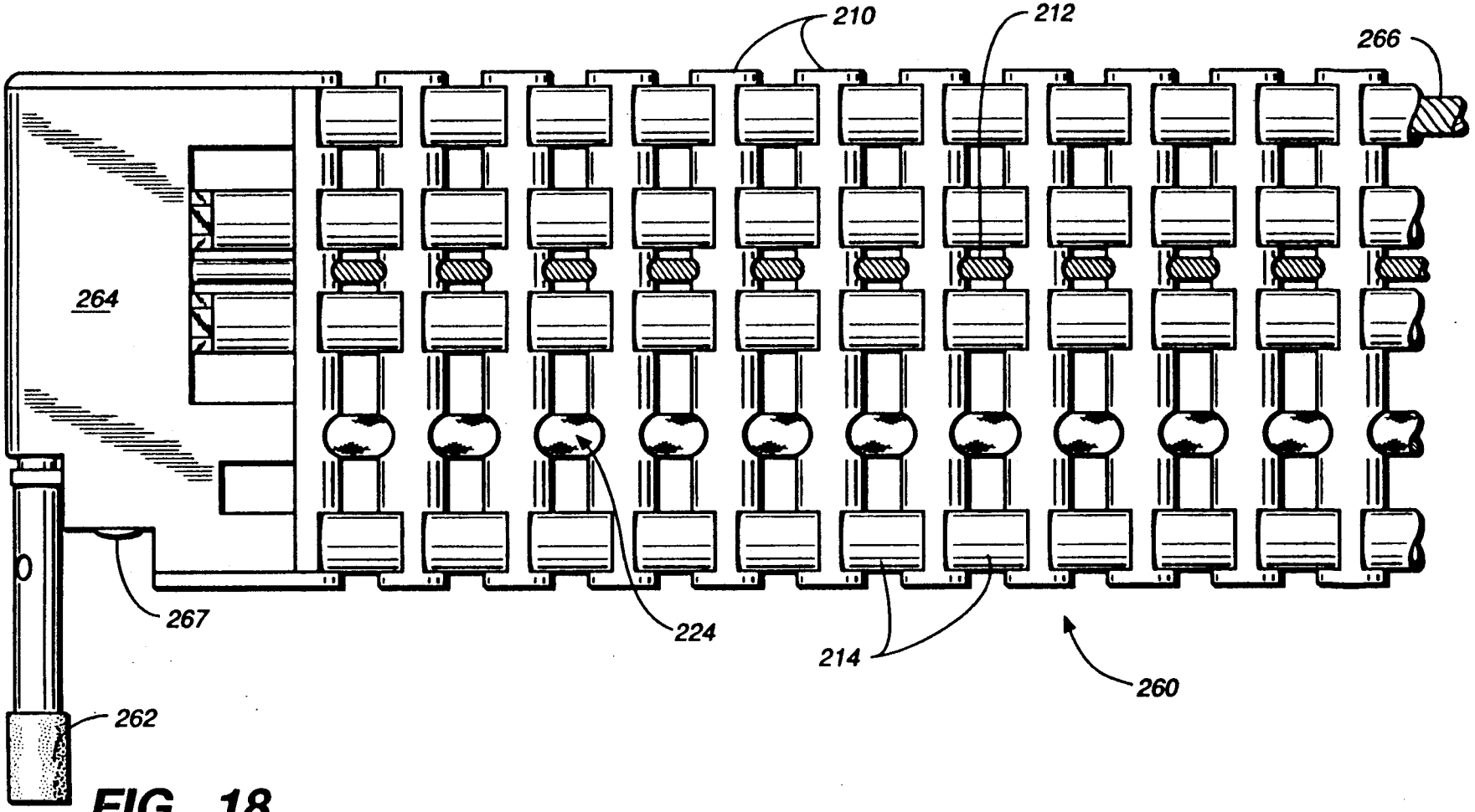
FIG. 18 is a plan view corresponding to FIG. 15, but of another form of the system portion in FIG. 15.

FIG. 18 shows another form of a flexible tool 260 that can be used in place of the flexible lance 200 in the system 202. The tool 260 has a diamond grit coated core drill 262 for obtaining core samples on a drill head 264 in place of the nozzle block 216 on the end of the flexible lance 200. The core drill 262 is driven by a helically wound flexible drive cable 266 that extends through the segments 210 making up the flexible tool 260. The flexible tool 260 includes a 6 mm right angle Welch Allyn VideoProbe 224 whose CCD camera 267 is fixed in the drill head 264. Other than as shown and described, the construction and operation of the flexible tool 260 is the same as that of the flexible lance 200.

Figure 19:
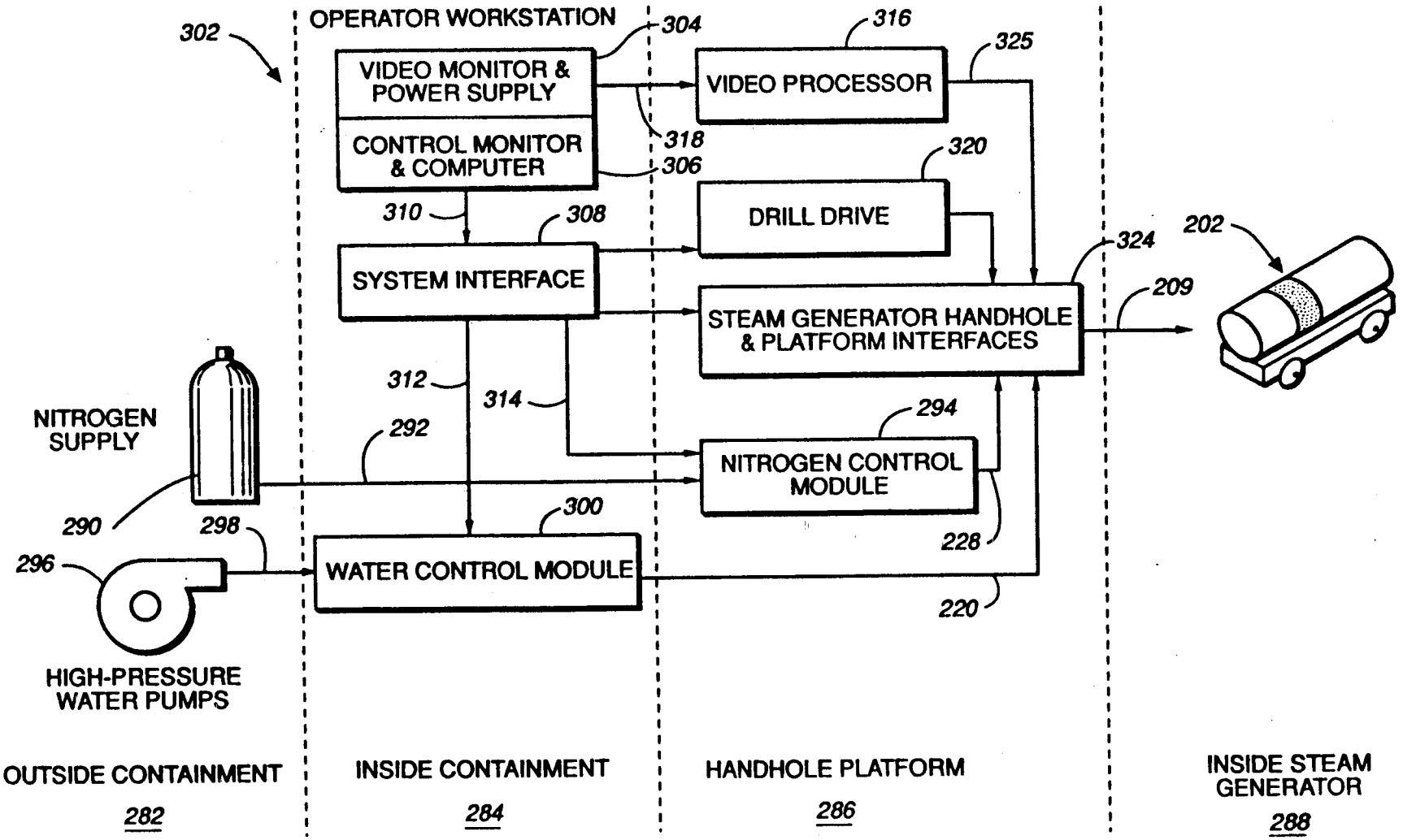
FIG. 19 is a block diagram of a control system used with the system of FIGS. 13-16.

FIG. 19 shows a control system 280 for the flexible lance system 202. The control system 280 is partitioned into four major sections: an outside containment section 282, an inside containment section 284, a handhole platform section 286 and an inside steam generator section 288. The outside containment section 282 comprises a nitrogen supply 290, connected by a nitrogen supply hose 292 to nitrogen control module 294 in the handhole platform section 286, and at least one high pressure water pump 296, connected by water supply hose 298 to water control module 300 in the inside containment section 284. The inside containment section 284 has an operator workstation 302 consisting of a video monitor and power supply 304 and a control monitor and computer 306, for example, a ruggedized industrial environment IBM PC/XT or equivalent. The control monitor and computer 306 is connected to system interface 308 by bus 310. The system interface 308 is connected to the water control module 300 by bus 312 and to nitrogen control module 294 by bus 314. The handhole platform section 286 includes a video processor 316 connected to the video monitor and power supply 304 by bus 318 and to steam generator handhole and platform interfaces 324 by bus 325. A drill drive 320 is connected to the system interface 308 by bus 322 and to the steam generator handhole and platform interfaces 324 by the flexible drive cable 266, which is further connected to the system 202 when the flexible tool 260 is employed in the system 202. The nitrogen control module 294 is connected to the interfaces 324 by nitrogen flow hose 228, which is also connected to the system 202 through the umbilical bundle 209. The interfaces 324 are connected to the system interface 308 by bus 327. The water control module is connected to the interfaces 324 by high pressure hose 220, which is also connected to the system 202 by the umbilical bundle 209.

In use of the system 280, the sensors 248 and 249 within the system 202 provide the operator with continuously updated information on lance position and barrel 206 rotational attitude. The data are displayed graphically on the computer monitor 306 in either plan or elevation views of the steam generator. Each display tells the operator the quadrant being cleaned, the tube column in which the flexible lance 200 is located, lance extension, in inches, into the tube bundle, the tube row number where the end of the lance 200 is located, the barrel 206 rotational angle, and the operational status of the system 202. As the lance 200 moves, feedback signals generated by the sensor 248 continuously monitor the actual position of the lance 200 inside the tube bundle. As the barrel 206 rotates, feedback from the sensor 249 updates the graphic display to show the exact orientation of the lance 200. When either camera 226 or 267, fiber optics cable 224 and video processor 316 are used to provide a video image from the end of the lance 200, position data are overlaid onto the video monitor 304 from the computer monitor 306. For example, the data can show that the lance 200 nozzle block 216 is currently in area one, column 31, tube row 9, with the lance extended 9.7, inches and the barrel rotated at an angle of 81 degrees clockwise from vertical. The date and time of the inspection can also be documented. All of the operations of the system 202 can be remotely controlled and monitored from the operator's workstation 302, located in a low radiation area.

It should now be readily apparent to those skilled in the art that a novel flexible lance and system for removal of sludge deposits from steam generators and similar assemblies with difficult to access geometries capable of achieving the stated objects of the invention has been provided. The system will position fluid discharge orifices of the flexible lance in close proximity to sludge deposits to be removed in all areas of the steam generators or other complex geometry assemblies. As a result, full system pressure of the cleaning fluid and optimum cleaning jet configuration is available at the sludge deposits for more complete sludge removal. While the structure and system of this invention is particularly useful for the removal of sludge deposits in PWR steam generators in the nuclear power industry because the structure and system is capable of operation with radiation levels of about 40 rads, it should find application in a wide variety of other difficult to access geometries as well.

It should further be apparent to those skilled in the art that various changes in form and detail of the invention as shown and described may be made. For example, the transporter could be designed to move in the annular space of the PWR steam generator, with the flexible lance jetting the sludge deposits and moving them toward the central blowdown lane. It is intended that such changes be included within the spirit and scope of the claims appended hereto.

What is claimed is:

1. A system comprising, in combination, a flexible means for accessing an assembly having a difficult to access geometry, which comprises a flexible member, a flexible cable extending lengthwise along and being movable within said flexible member, and an optical cable extending lengthwise along and within said flexible member, said flexible member being configured to be driven into the difficult to access geometry, a rigid guide extending lengthwise of said flexible member, said flexible member being movably mounted along said rigid guide, said rigid guide having a curved end positioned to turn said flexible member in a predetermined angle with respect to an extending direction of said flexible member as said flexible member passes from said rigid guide through said curved end, a drive means for driving said flexible member through the curved end of said rigid guide, a transporter for said combination, in which said rigid guide comprises a body of said transporter, and at least one transporter drive means attached to said body.

2. The system of claim 1 in which said flexible member comprises a sheet-like plastic extrusion.

3. The system of claim 2 in which said plastic extrusion is configured to be driven into the difficult to access geometry by having a plurality of rows of sprocket holes.

4. The system of claim 1 in which said drive means for driving said flexible lance through the curved end of said rigid guide comprises a plurality of sprockets fixedly attached to a shaft, said plurality of sprockets each having a plurality of teeth positioned to engage said flexible member, and a means for rotating said shaft.

5. The system of claim 4 additionally comprising a means for orienting the curved end of said rigid guide relative to the assembly having the difficult to access geometry.

6. The system of claim 5 in which said means for orienting comprises a drive connected to rotate said body about an axis extending along said flexible member.

7. The system of claim 5 in which said transporter includes a plurality of clamps for mounting said transporter for movement along a pipe.

8. The system of claim 7 in which said at least one transporter drive means comprises a means for extending a gripper laterally of said body and a means for reciprocating said gripper extending means along said body.

9. The system of claim 8 in which said flexible means for accessing includes at least one fluid delivery passage extending lengthwise along and within said flexible member.

10. The system of claim 1 in which said at least one transporter drive means comprises a drive wheel rotatably connected to said body and a means coupled to rotate said drive wheel.

11. The system of claim 1 additionally comprising means for positioning said rigid guide curved end with respect to the difficult to access geometry.

12. A system comprising, in combination, a flexible means for accessing an assembly having a difficult to access geometry, which comprises a flexible member, and an optical cable extending lengthwise along and within said flexible member, said flexible member being configured to be driven into the difficult to access geometry, a rigid guide extending lengthwise of said flexible member, said flexible member being movably mounted along said rigid guide, said rigid guide having an end positioned to turn said flexible member in a predetermined angle with respect to an extending direction of said flexible member as said flexible member passes from said rigid guide through said end, a drive means for driving said flexible member through said rigid guide, said drive means for driving said flexible member through the end of said rigid guide comprising a plurality of sprockets fixedly attached to a shaft, said plurality of sprockets each having a plurality of teeth positioned to engage said flexible member, and a means for rotating said shaft, a transporter for said combination, in which said rigid guide comprises a body of said transporter, at least one transporter drive means attached to said transporter, a means for orienting the end of said rigid guide relative to the assembly having the difficult to access geometry, said means for orienting comprising a drive connected to rotate said body about an axis extending along said flexible member.

13. The system of claim 12 additionally comprising a means for positioning said end with respect to the difficult to access geometry.

14. A system comprising, in combination, a flexible means for accessing an assembly having a difficult to access geometry, which comprises a flexible member, and an optical cable extending lengthwise along and within said flexible member, said flexible member being configured to be driven into the difficult to access geometry, a rigid guide extending lengthwise of said flexible member, said flexible member being movably mounted along said rigid guide, said rigid guide having an end positioned to turn said flexible member in a predetermined angle with respect to an extending direction of said flexible member as said flexible member passes from said rigid guide through said end, a drive means for driving said flexible member through said rigid guide, a transporter for said combination, in which said rigid guide comprises a body of said transporter, and at least one transporter drive means attached to said transporter, said flexible member comprising separate segments strung on at least one flexible cable which runs the length of the flexible member.

15. The system of claim 14 i which said at least one flexible cable is attached to a nozzle block by at least one stud and at least one high pressure water conduit passes through the segments and the spacers and are connected to at least one water jet on the nozzle block.

16. The system of claim 12 in which said flexible means for accessing includes at least one fluid delivery passage extending lengthwise along and within said flexible means for accessing.

17. The system of claim 14 additionally comprising a control system for said system, said control system comprising a data processing workstation remote from the difficult to access geometry, said data processing workstation being connected to interfaces for said optical cable, said drive means for driving said flexible member and said transporter drive means, said interfaces being proximate to an access to the difficult to access geometry.

18. A system comprising, in combination, a flexible means for accessing an assembly having a difficult to access geometry, which comprises a flexible member, and an optical cable extending lengthwise along and within said flexible member, said flexible member being configured to be driven into the difficult to access geometry, a rigid guide extending lengthwise of said flexible member, said flexible member being movably mounted along said rigid guide, said rigid guide having an end positioned to turn said flexible member in a predetermined angle with respect to an extending direction of said flexible member as said flexible member passes from said rigid guide through said end, a drive means for driving said flexible member through said rigid guide, a transporter for said combination, in which said rigid guide comprises a body of said transporter, and at least one transporter drive means attached to said transporter, said rigid guide being rotatable about a length of said flexible member, said system additionally including a first sensor in said transporter for measuring extension of said flexible lance into the difficult to access geometry and a second sensor for measuring rotation of said rigid guide member.

19. In combination, a flexible means for accessing an assembly having a difficult to access geometry, which comprises a flexible member, a flexible cable extending lengthwise along and being movably within said flexible member, and an optical cable extending lengthwise along and within said flexible member, said flexible member being configured to be driven into the difficult to access geometry, said flexible member being configured to be driven into the difficult to access geometry by having a plurality of rows of sprocket holes, a drive means for said flexible means for accessing, comprising a plurality of sprockets fixedly attached to a shaft, said plurality of sprockets each having a plurality of teeth positioned to engage said sprocket holes, and a means for rotating said shaft, a rigid guide extending lengthwise of said flexible means for accessing, said flexible means for accessing being movably mounted along said rigid guide, said rigid guide having a curved end positioned to turn said flexible means for accessing in a predetermined angle with respect to an extending direction of said flexible means for accessing as said flexible means for accessing is driven by said drive means through said curved end and a transporter for said combination, in which said rigid guide comprises a body of said transporter, and at least one transporter drive means attached to said body.

20. The combination of claim 19 additionally comprising an orienting member movable laterally from said body and positioned to engage a structure positioned adjacent said transporter and opposite said orienting member for tilting said body.

21. The combination of claim 20 in which said transporter includes a plurality of clamps for mounting said transporter for movement along a pipe.

22. The combination of claim 21 in which said at least one transporter drive means comprises a means for extending a gripper laterally of said body and a means for reciprocating said gripper extending means along said body.

23. The combination of claim 22 in which said flexible means for accessing includes at least one fluid delivery passage extending lengthwise along and through said flexible member.

24. A flexible means for accessing an assembly having a difficult to access geometry including a plurality of parallel gaps between parallel, extending elements from an access lane which is perpendicular to the parallel gaps, which comprises a substantially planar flexible member comprising a plurality of separate segments strung on at least a pair of flexible cables extending within said planar flexible member through each of said segments, said segments extending transversely between said pair of flexible cables in a single plane when said flexible member is flat, said segments being parallel to one another, said flexible member being flexible along a direction normal to the single plane, and an optical cable extending lengthwise along and within said flexible member, said flexible member being configured to be driven into the parallel gaps of the difficult to access geometry.

25. The flexible means for accessing an assembly having a difficult to access geometry of claim 24 in which said flexible means for accessing includes at least one fluid delivery line extending lengthwise along and passing through said plurality of segments.

26. The flexible means for accessing an assembly having a difficult to access geometry of claim 25 in which said at least one fluid delivery line includes a pressurized liquid delivery line.

27. The flexible means for accessing an assembly having a difficult to access geometry of claim 26 in which said at least one fluid delivery line includes a pressurized gas delivery line.

28. A flexible means for accessing an assembly having a difficult to access geometry, which comprises a flexible member comprising a plurality of separate segments strung on at least a pair of flexible cables, said segments extending transversely between said pair of flexible cables, said segments being parallel to one another, and an optical cable extending lengthwise along and within said flexible member, said flexible member being configured to be driven into the difficult to access geometry, said flexible member being configured to be driven into the difficult to access geometry by having a plurality of rows of sprocket holes defined by spaces between said separate segments.

29. In combination, the flexible means for accessing a difficult to access geometry of claim 28 and a drive means for said flexible means for accessing, comprising a plurality of sprockets fixedly attached to a shaft, said plurality of sprockets each having a plurality of teeth positioned to engage said sprocket holes, and a means for rotating said shaft.

30. A flexible means for accessing an assembly having a difficult to access geometry, which comprises a flexible member comprising a plurality of separate segments strung on at least a pair of flexible cables, said segments extending transversely between said pair of flexible cables, said segments being parallel to one another, and an optical cable extending lengthwise along and within said flexible member, said flexible member being configured to be driven into the difficult to access geometry, said flexible means for accessing an assembly having a difficult to access geometry including a core drill and said at least one flexible cable including a flexible drive cable that is movable within said flexible member and is connected to drive said core drill.

31. A flexible means for accessing an assembly having a difficult to access geometry including a plurality of parallel gaps between parallel, extending elements from an access lane which is perpendicular to the parallel gaps, which comprises a substantially planar flexible member comprising a plurality of separate segments strung on at least a pair of flexible cables extending within said planar flexible member through each of said segments, said segments extending transversely between said pair of flexible cables in a single plane when said flexible member is flat, said segments being parallel to one another, said flexible member being flexible along a direction normal to the single plane, said flexible member being configured to be driven into the parallel gaps of the difficult to access geometry.

32. The flexible means for accessing an assembly having a difficult to access geometry of claim 31 in which said flexible means for accessing includes at least one fluid delivery line extending lengthwise along and passing through said plurality of segments.

33. The flexible means for accessing an assembly having a difficult to access geometry of claim 32 in which said at least one fluid delivery line includes a pressurized liquid delivery line.

34. The flexible means for accessing an assembly having a difficult to access geometry of claim 33 in which said at least one fluid delivery line includes a pressurized gas delivery line.

35. A flexible means for accessing an assembly having a difficult to access geometry, which comprises a flexible member comprising a plurality of separate segments strung on at least a pair of flexible cables, said segments extending transversely between said pair of flexible cables, said segments being parallel to one another, said flexible member being configured to be driven into the difficult to access geometry, said flexible member being configured to be driven into the difficult to access geometry by having a plurality of rows of sprocket holes defined by spaces between said separate segments.

36. In combination, the flexible means for accessing a difficult to access geometry of claim 35 and a drive means for said flexible means for accessing, comprising a plurality of sprockets fixedly attached to a shaft, said plurality of sprockets each having a plurality of teeth positioned to engage said sprocket holes, and a means for rotating said shaft.

37. A flexible means for accessing an assembly having a difficult to access geometry, which comprises a flexible member comprising a plurality of separate segments strung on at least a pair of flexible cables, said segments extending transversely between said pair of flexible cables, said segments being parallel to one another, said flexible member being configured to be driven into the difficult to access geometry, said flexible means for accessing an assembly having a difficult to access geometry including a core drill and said at least one flexible cable including a flexible drive cable that is movable within said flexible member and is connected to drive said core drill.

38. The system of claim 14 in which the segments are separated by spacers.

39. The system of claim 14 in which said at least one flexible cable comprises at least a pair of flexible cables, said segments extending transversely between said pair of flexible cables, said segments being parallel to one another.

40. The flexible means for accessing an assembly having a difficult to access geometry of claim 14 in which said flexible means for accessing includes at least one fluid delivery line extending lengthwise along and passing through said plurality of segments.

41. The flexible means for accessing an assembly having a difficult to access geometry of claim 40 in which said at least one fluid delivery line includes a pressurized liquid delivery line.

42. The flexible means for accessing an assembly having a difficult to access geometry of claim 41 in which said at least one fluid delivery line includes a pressurized gas delivery line.

43. The flexible means for accessing a difficult to access geometry of claim 14 in which said flexible member is configured to be driven into the difficult to access geometry by having a plurality of rows of sprocket holes defined by spaces between said separate segments.

* * * * *